US005115597A

United States Patent [19]

Tillery et al.

[11] Patent Number: 5,115,597

[45] Date of Patent: May 26, 1992

[54] UNIVERSAL DOOR JAMB OF THREE PIECE CONSTRUCTION SUITABLE FOR FOUR MODES OF OPERATION

[76] Inventors: Lawrence I. Tillery, 225 W. Franklin Rd., Meridian, Id. 83642; Keith W. Cline, 1252 E. Victory Rd., Meridian, Id. 83642; Ronald R. Moses, 3812 Gulley Ave., Boise, Id. 83709; Kurtis K. Cline, 1252 E. Victory Rd., Meridian, Id. 83642

[21] Appl. No.: 706,761

[22] Filed: May 29, 1991

[51] Int. Cl.[5] ..... F06B 1/04

[52] U.S. Cl. ..... 49/504; 52/211

[58] Field of Search ..... 49/382, 504, 506; 52/204, 210, 211

[56] References Cited

U.S. PATENT DOCUMENTS

| | | | |
|---|---|---|---|
| 2,541,871 | 2/1951 | Heijmer et al. | 49/382 X |
| 3,226,775 | 1/1966 | Workmon | 49/382 |
| 4,067,157 | 1/1978 | Robinson | 49/504 X |
| 4,479,335 | 10/1984 | Roberts et al. | 49/504 X |
| 4,662,112 | 5/1987 | Bursk | 49/504 X |

*Primary Examiner*—Renee S. Luebke
*Assistant Examiner*—Jerry Redman
*Attorney, Agent, or Firm*—William J. Bethurum

[57] ABSTRACT

A universal door jamb package of essentially three piece construction and suitable for operation with standard layout doors having knobs spaced approximately thirty-six inches from the bottom edge of the door. The three piece construction package for shipment to the builder comprises a hinge jamb leg with both ends thereof squared off and having symmetrically spaced hinges thereon on one side of a door stop strip. The packaged striker jamb leg is dadoed at both ends thereof and has a striker plate symmetrically spaced thereon on one side of a door stop strip. The package further includes a header jamb member which is squared off at end thereof and is dadoed at the other end thereof. Upon receipt of this package by the builder at a construction site, one of the two ends of the striker jamb leg is cut off by a predetermined distance to thereby square off the end of the striker jamb leg which is to abut a floor or carpet, thereby bringing the striker plate to a distance of approximately thirty-six inches from the cut off end of the striker jamb leg. Then, the header jamb member is positioned with its squared off end adjacent to the dadoed end of the striker jamb leg and is also positioned with its dadoed end covering the squared off end of the hinge jamb leg. Thus, the correct vertical orientation of each of the two door jamb legs and the correspondingly correct horizontal orientation of the header jamb member may be made at the construction site to accommodate both left handed and right handed doors of the standard layout configuration swingable both into and away from a room to which the door jamb is connected.

6 Claims, 6 Drawing Sheets

FIG. 4C.
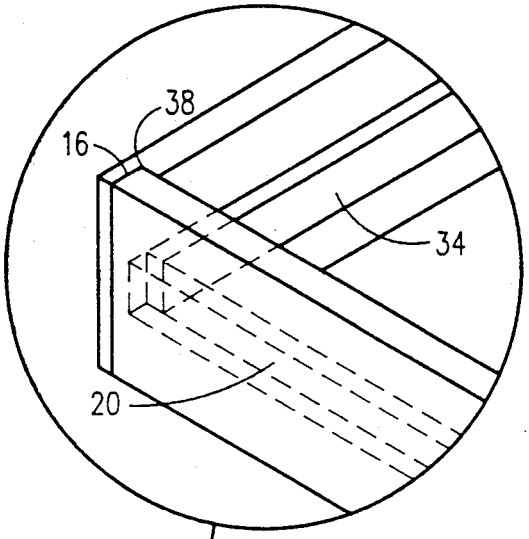
FIG. 4B.
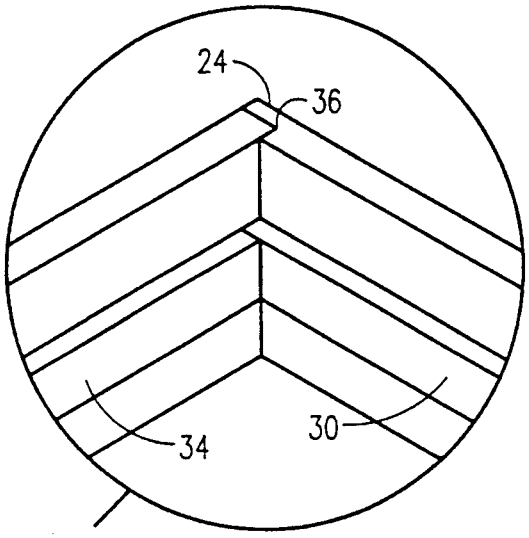
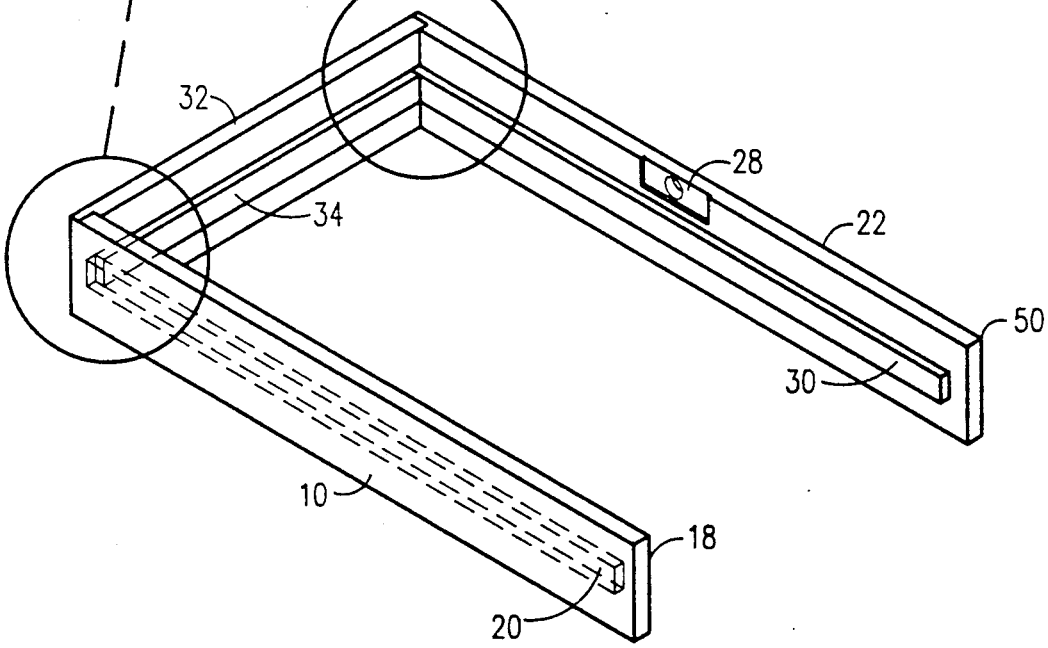
FIG. 4A.

UNIVERSAL DOOR JAMB OF THREE PIECE CONSTRUCTION SUITABLE FOR FOUR MODES OF OPERATION

TECHNICAL FIELD

This invention relates generally to improvements in door jamb construction and more particularly to a universal three piece door jamb assembly which may be constructed by the builder for four different modes of operation. In addition, the universal door jamb described herein has been specifically constructed for use with doors having asymmetrically spaced door knobs thereon.

BACKGROUND ART

In the field of door jamb construction for a wide variety of different door types and uses, it has been a common practice to configure the two legs of the jamb differently for left and right hand doors and also differently depending upon whether the door swings toward or away from a room to which it is joined. That is, the two legs of the jamb each have a vertical door stop strip centrally positioned on their inner facing surfaces. These legs are located adjacent to a wall end surface on each side of a door opening and support a head piece or "header" at the top of the door. Each door jamb leg must therefore have a "dado" or offset shelf region at their tops for receiving the header in smooth and flush engagement as is well known. Then, depending upon whether the door is left handed or right handed and further depending upon whether the door is to swing inwardly or outwardly of the room to which it is attached, one leg of the jamb must be constructed to have receptacles for the door hinges located on a specified side of the vertical door stop strip and the other door jamb leg must be constructed so that the receptacle for the striker plate is also located on a specified side of the vertical door stop strip. This receptacle placement requirement in turn meant that two differently constructed door jamb legs were required for door hinge mounting and two differently constructed door jamb legs were required for door striker plate mounting.

The above requirements for both right handed and left handed differently configured jamb legs to accommodate the four (4) possible modes of door operation meant the per se expensive requirement for providing four (4) different jamb leg configurations for receiving the door hinges and striker plate on both sides of the vertical door stop strip. Furthermore, in large construction projects which might require, for example, six hundred (600) right hand doors and three hundred (300) left hand doors, the correct number of right handed and left handed door jamb legs always had to be sorted out and furnished to the construction site. The latter requirement, in turn, served to increase the cost and manpower for sorting and marshalling the correct type of door jamb legs necessary to complete a given construction project.

RELATED APPLICATION

In United States Patent application Ser. No. 07/573,258 of Lawrence Ivan Tillery et al filed Aug. 23, 1990, and entitled "Universal Door Jamb Suitable For Use With Both Left Hand and Right Hand Doors in Four Modes of Operation", there is disclosed and claimed new and useful improvements in the art of door jamb construction. Using the novel construction techniques and teachings of our prior application which is incorporated herein by reference, a door jamb may be assembled so that it is operative with either left handed or right handed doors swingable either inwardly into or outwardly from a room to which the door jamb is connected.

The door jamb of our prior application is suitable for use with doors having the door knob thereof symmetrically spaced halfway between the top and bottom edges of the door, or typically forty inches from the bottom edge of the door. However, one or more of the independent claims of our prior co-pending application Ser. No. 07/573,258 are generic to the embodiments of the present invention described below. Furthermore, as will be better appreciated in the description that follows, the claims of the present application are considered to be clearly patentable over our prior invention in U.S. Patent application Ser. No. 07/573,258 even though the disclosure of this application is not available as prior art against the claims herein and patentability over our own above patent application is not required.

DISCLOSURE OF INVENTION

The general purpose and principal object of the present invention is to adapt in a novel manner the new and useful improvements of our co-pending application Ser. No. 07/573,258 to doors where the door knobs thereof are not centered, but rather are located closer to the bottom edge of the door than to the top edge thereof. This latter distance is typically thirty-six inches for doors having what is known in the art as a standard door layout, and generally speaking these thirty-six inch door knob spacings are found more frequently found in older homes or the more expensive homes or both.

In accordance with the present invention, we have discovered and developed still further new and useful improvements in the art of door jamb construction, and these improvements are directed to providing an essentially three piece door jamb construction package comprising a hinge jamb leg, a striker jamb leg, and a header jamb member, all of which have been configured in such a manner that enables the builder, upon receipt of the door jamb package at a construction site, to assemble the three pieces contained therein to fit either a left handed door or a right handed door, either of which may swing into or away from a room to which the door jamb is connected. Thus, the present invention includes all of the advantages of our prior invention disclosed and claimed in U. S. Patent application Ser. No. 07/573,258, but unlike our prior invention, is directed to doors and door jambs having non-symmetrical door knobs such as those which have been customarily positioned for many years thirty-six inches from the bottom edge of the door and forty-four inches from the top edges of most doors.

To accomplish the above purpose and objects and gain all of the attendant advantages of our prior invention while simultaneously eliminating some piece parts required thereby, the packaged striker jamb leg of the present invention is dadoed at both ends thereof, whereas the hinge jamb leg is squared off and not dadoed at either of its two ends. On the other hand, the header jamb member is dadoed at one end thereof and is squared off and not dadoed at the other end thereof. As in the case of our prior co-pending patent application Ser. No. 07/573,258, each of the hinge and striker jamb legs are packaged for shipping with both the hinges and the striker plate being symmetrically spaced with respect to the tops and bottoms of the two jamb legs to which they are affixed.

When the builder at the construction site receives this symmetrical package of essentially three piece construction (hinge jamb leg, striker jamb leg, and header jamb member), he first considers whether the door is a right handed door or a left handed door and whether the door swings inwardly into a room or away therefrom. Having made the determination of which one of the above four possible modes of operation that the door will function, he then cuts or squares off the lower end of the striker jamb leg at a predetermined distance, e.g. thirty-six inches, from the center of the striker plate to thereby define the squared off end of the striker jamb leg which will abut with either an adjacent floor or carpet. He then determines the proper orientation for the hinge jamb leg and he then cuts off a predetermined length at the top of the hinge jamb leg at which the dadoed end of the header jamb member will be received.

The striker jamb leg which was packaged for shipment was made approximately seven and three-quarter (7¾) inches longer than is ultimately required for installation and the hinge jamb leg was made approximately four and one-half (4½) inches longer than is required for installation, and with the striker jamb leg squared off at its lower end, neither jamb leg is dadoed where it meets the floor or carpet. This feature is in significant contrast to the door jamb construction of our prior application Ser. No. 07/573,258 where it is necessary to insert plugs in the dadoed lower ends of both the hinge and striker jamb legs. Thus, in the present application these plug members are not required. However, we now have a squared off hinge jamb leg top surface opposed to a dadoed striker jamb leg top surface. Thus, in our novel and elegantly simple packaged arrangement of the present invention, the header jamb member which itself has one dadoed end and one squared off end, but is symmetrical in all other respects, can now be correctly rotated in the horizontal plane to one of its two possible horizontal positions to thereby precisely match the abutting dadoed end of the striker jamb leg and the squared off end of the hinge jamb leg.

Another object of this invention is to provide a new and improved universal door jamb of the type described which may be economically constructed and packaged using a minimum number of individual piece parts.

Another object of this invention is to provide a new and improved universal door jamb of the type described which is easy to assemble and which does not require that the jamb assembler first match the jamb leg configuration to left hand or right hand doors for movement in two different directions of swing.

A further object of this invention is to provide a new and improved door jamb of the type described which is easily scalable to fit any asymmetrical door knob spacing.

Another object of this invention is to provide a new and improved door jamb construction of the type described which serves to reduce the amount of jamb piece part inventory which must be stocked.

Yet another object of this invention is to minimize both jamb assembly costs and the cost of sorting and marshalling jamb piece parts necessary for a particular construction project.

The above novelty and elegant simplicity of door jamb construction in accordance with the teachings of the present invention, together with its above objects and attendant advantages and novel features, will become more readily apparent from the following description of the accompanying drawings.

BRIEF DESCRIPTION OF THE DRAWINGS

FIG. 4A is an angled isometric view showing in some detail the mating of the header jamb member with a dadoed end of the striker jamb leg and a squared off end of the hinge jamb leg.

FIGS. 4B and 4C are enlarged fragmented isometric views of the right side and left side fits between the header jamb member and the striker jamb leg and hinge jamb leg top ends, respectively.

DETAILED DESCRIPTION OF THE DRAWINGS

Figure 1A:
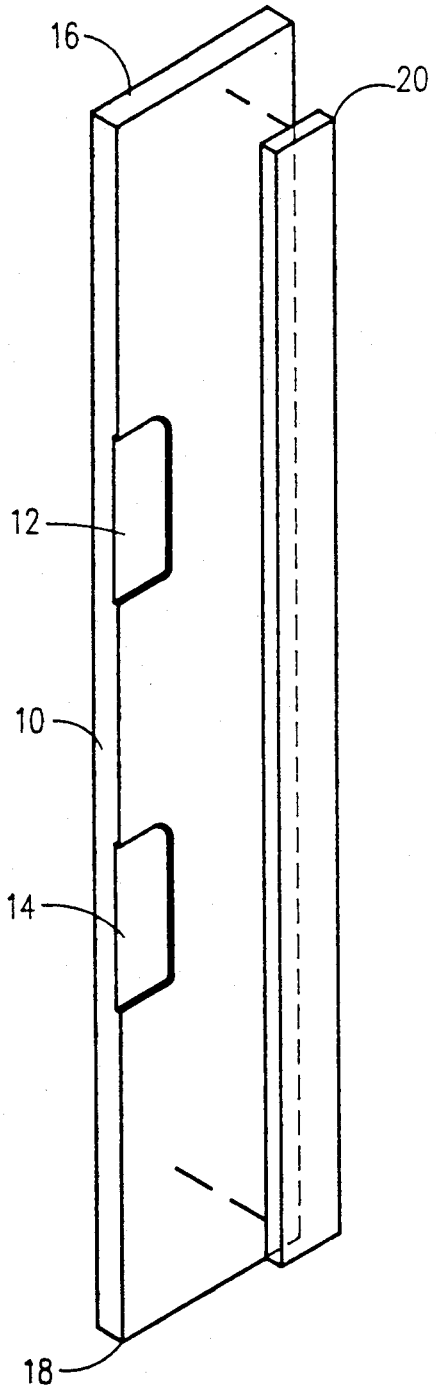
FIGS. 1A and 1B are isometric views, respectively, showing the hinge jamb leg and the striker jamb leg in which symmetrically spaced receptacles have been cut for the door hinges and striker plate, respectively.

Referring now to FIG. 1A, a hinge jamb leg 10 is constructed to have a pair of symmetrically spaced hinge receptacles 12 and 14 which are spaced a predetermined distance from the squared off top and bottom surfaces 16 and 18 of the jamb leg 10. The hinge jamb leg 10 is further provided with a center door stop strip 20 which is centrally positioned as shown between the flat top and bottom surfaces 16 and 18 of the hinge jamb leg. In one door jamb package currently under construction, the hinge jamb leg is eighty six (86) inches long.

Figure 1B:
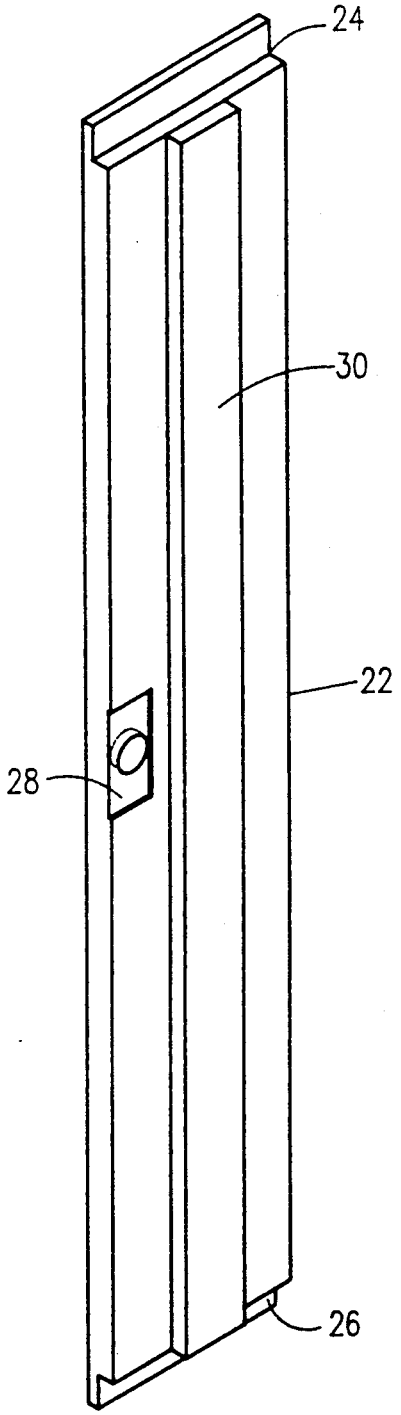

Referring now FIG. 1B, a striker jamb leg 22 is dadoed at both the end locations 24 and 26 thereof as indicated and it has a striker receptacle 28 mounted halfway between these dadoed end sections 24 and 26. A center door stop strip 30 is positioned as shown in the center of the striker jamb leg 22 and between the dadoed sections 24 and 26 as shown. In the same above door jamb package currently under construction, the striker jamb leg is eighty nine and one-half (89½) inches long.

Figure 1C:
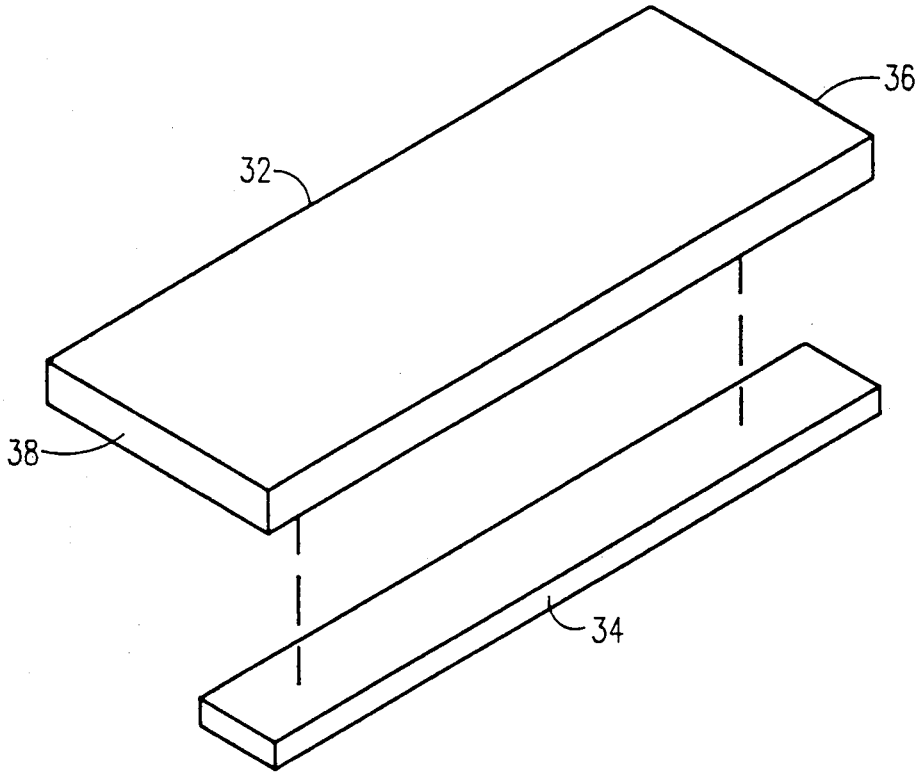
FIG. 1C is an isometric view of the header jamb member to which the hinge and striker jamb legs will be joined.

Referring now to FIG. 1C, a header jamb member 32 is also provided with a center door stop strip 34 which is positioned on the downwardly facing surface of the header 32 and is cut to a length so that it comes into direct abutment with the tops of the two door stop strips 20 and 30 on the two jamb legs 10 and 22. The header jamb member is squared off on one end 36 and is dadoed on its other end as indicated at the location 38.

The header jamb member is typically thirty-seven (37) inches long for accommodating a three foot wide door.

Figure 2A:
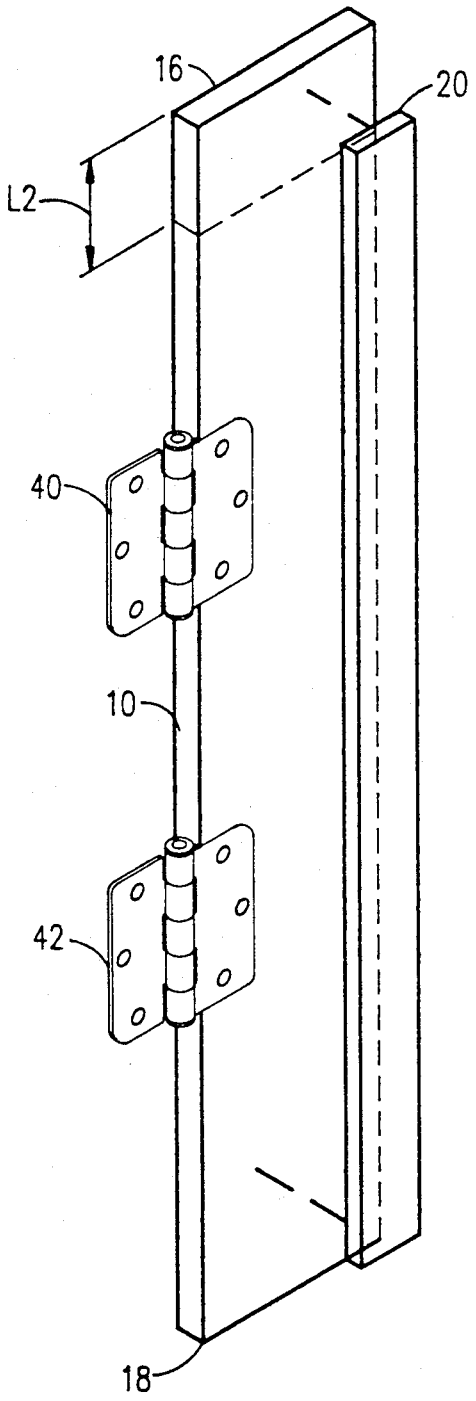
FIGS. 2A and 2B show, respectively, the hinge jamb leg and the striker jamb leg to which the door hinges and striker plate, respectively, have been secured, and with the arrow indicating the location on and length of the striker jamb leg where this leg will be cut and squared off. Notice that both ends of the striker jamb leg are initially dadoed, whereas both ends of the hinge jamb leg are initially squared off.
Figure 2B:
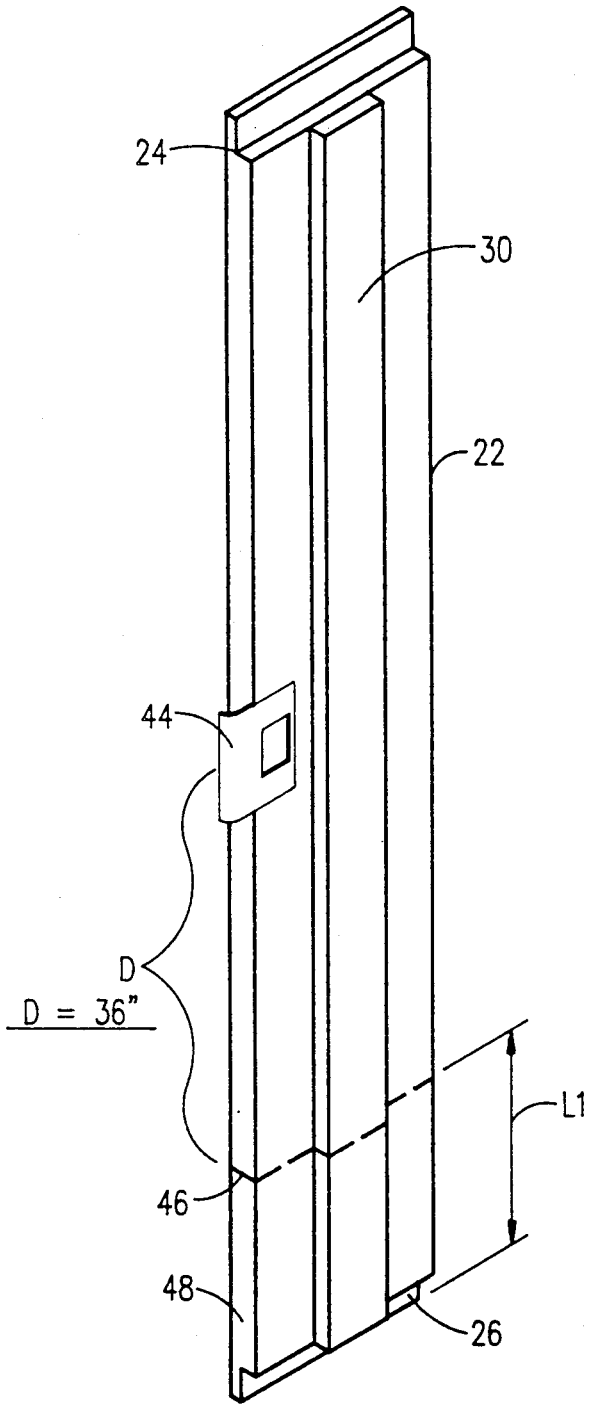

Referring now to FIGS. 2A and 2B, a pair of hinges 40 and 42 have been affixed to the hinge jamb leg 10 and a striker plate 44 has been affixed to the striker jamb leg 22. Once the right hand/left hand door orientation and the inwardly swing or outwardly swing mode of operation have been determined, then the builder knows which one of the two possible vertical orientations the striker jamb leg 22 must assume in order to vertically match the position of the striker plate 44 with a corresponding position of the door knob and striker (not shown). In this position, the striker plate 44 will be received by the door knob and striker at approximately a distance, D, as indicated of typically thirty-six inches from the bottom edge 46 of the striker jamb leg 22 for a standard door layout. When this determination has been made, then one end piece 48 of the striker jamb leg 22 is cut off in the plane 46 to thus produce the squared off lower edge 50 of the striker jamb leg as shown in FIGS. 3A and 3B.

Thus, since it is desired that the striker plate center line be brought 36" from the floor while simultaneously eliminating the dadoed lower end of the striker jamb leg, then this is the reason that it is the striker jamb leg rather than the hinge jamb leg that is dadoed at both of its ends. For the standard door layout, we cut off 7¾" for the length noted as "L1" in FIG. 2B to arrive at a distance "D" of thirty-six (36) inches from the center of the striker plate 44 to the plane 46 which will rest adjacent to the floor or carpet beneath the striker jamb leg 22. This length reduction for the striker jamb leg shortens its total length to eighty one and one-half (81½) inches, thereby leaving one inch for carpet clearance, ⅜" for the depth of the dado, and ⅛ for door head clearance. In a similar manner, the length "L2" in FIG. 2A is cut off at four and one-half (4½) inches on its upper end as oriented in this figure to thereby reduce the 86" length of the hinge jamb leg to 81½" to match the new length of the striker jamb leg and thus bring the top of the upper hinge 40 to within eleven inches of the top of the door, which again is dimensioned in accordance with the standard door layout which is well familiar to workers in the field of door and door jamb construction.

Figure 3A:
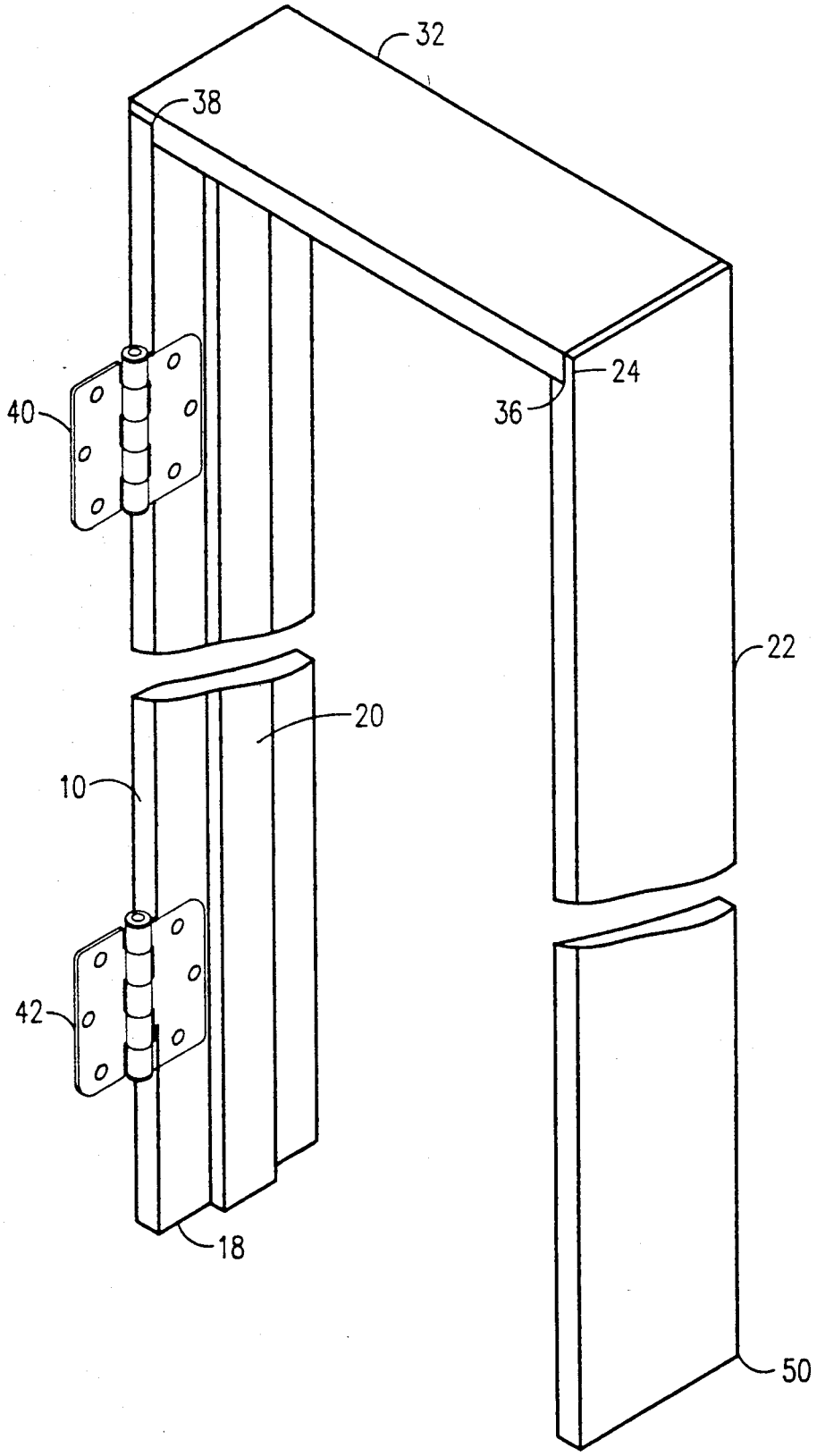
FIG. 3A is an isometric view of the assembled door jamb in which the door hinge leg is shown in facing detail.
Figure 3B:
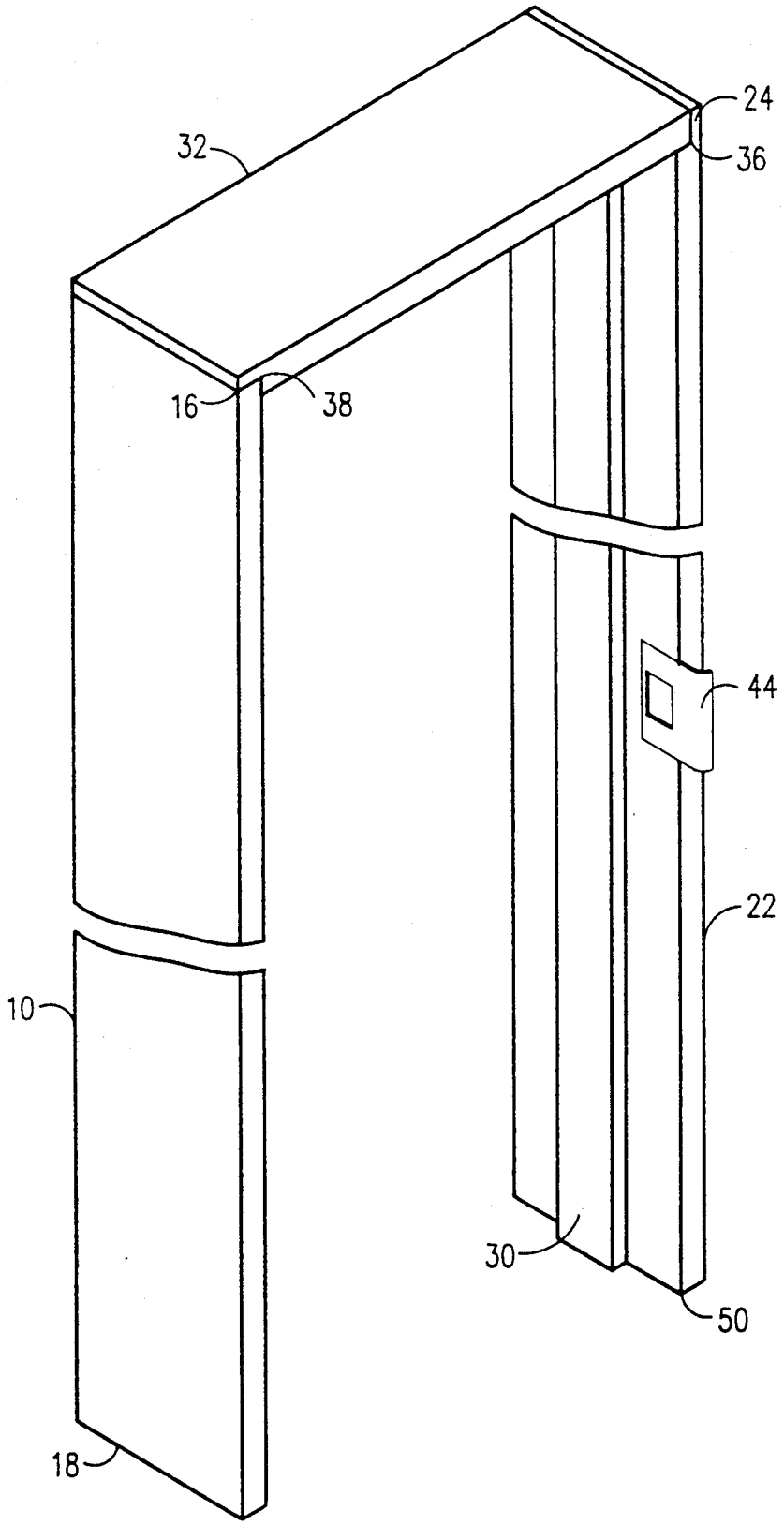
FIG. 3B is an isometric view of the assembled door jamb in which the striker plate leg is shown in facing detail.

Referring now to FIGS. 3A and 3B, the hinge and striker jamb legs 10 and 22 are now positioned to receive the header jamb member 32 as shown and having one squared off end 36 to receive the dadoed end of the striker jamb leg 22 and having its own dadoed end 38 correctly positioned to receive the top squared off end 16 of the hinge jamb leg 10. Thus, the header jamb member 32 need only be rotated to one of its two possible horizontal orientations in order to receive either a hinge jamb leg or a striker jamb leg at a left hand location, for example, and a striker jamb leg or a hinge jamb leg at an opposing right hand location, depending upon whether the door jamb is to receive a right handed door or a left handed door. In the example shown in FIG. 3A, the hinge jamb leg 10 receives the dadoed end section 38 of the header jamb member 32, and the squared off end 36 of the header jamb member 32 is received by the dadoed end section 24 of the striker jamb leg 22. FIG. 3B shows the same horizontal orientation for the header jamb member 32 in a reversed isometric orientation with the striker jamb member 22 shown in facing detail.

Referring now to FIGS. 4A, 4B, and 4C, the exact mating of the ends of the header jamb member 32 with the top ends of the hinge jamb leg 10 and the striker jamb leg 22 is shown in a particular isometric view orientation wherein the squared off end 36 of the header jamb member 32 is shown being received by the dadoed end 24 of the striker jamb leg and further wherein the dadoed other end 38 of the header jamb member covers the top end 16 of the hinge jamb leg 10. Thus, as shown in the more enlarged isometric and fragmented views of FIGS. 4B and 4C, the door stop strip 34 on the under surface of the header jamb member 32 abuts up against an inner surface of the hinge jamb door stop strip 20 at the top end 16 of the hinge jamb leg 10 and also abuts up against the other door stop strip 30 on the striker jamb leg 22.

Various modifications may be made in and to the above described embodiments without departing from the spirit and scope of our invention. For example, the above door jamb constructions may be scaled to any size and used with various types of door hinges and striker plates in order to accommodate a large number of different types of both left handed and right handed doors operatively swingable both inwardly into and outwardly from a room to which the door jamb is connected. In addition, the above novel door jamb construction and geometries shown in the drawings may be made using many different means such as nails, screws, adhesives and the like for securing the above header jamb member, jamb legs, door stop strips, hinges and striker plates in place. All of these header to jamb leg fastening techniques may be used to straighten out and compensate for the warpage which one encounters using "coped" mating techniques of the type described in U.S. Pat. No. 3,226,775 issued to Workmon and cited against our above-identified co-pending application Ser. No. 07/573,258.

It should also be understood that the present invention is not limited to the use of residential interior doors, but additionally may be used with both residential and commercial doors which provide entry into and exit from a building to the outdoors. Normally, a residential entry or exit door will swing into the interior of the residence, whereas a door used for the entry and exit to a commercial building will swing outwardly of the building.

The present invention is applicable to all of the above applications and design modifications thereof as will be understood by those skilled in the art. In addition, the present invention is not limited to the use of the asymmetrical 36"–44" door knob spacing given by way of example above, and may also be used with various other asymmetrical door knob spacings as may be desirable for particular types of custom door designs. Accordingly, these and other obvious design modifications and constructional variations are clearly within the scope of the following appended claims.

We claim:

1. A door jamb assembly package for shipment to a builder and of essentially three major piece construction, including, in combination:

a. A hinge jamb leg including a door stop strip centrally positioned thereon and spaced hinges located on one side of said door stoop strip, said hinge jamb leg having squared off and flat end faces on both ends thereof, b. a striker jamb leg having dadoed or offset sections on both ends thereof and a door stop strip extending therebetween, and a striker plate being symmetrically spaced on one side of said door stop strip an equal distance from both of said dadoed or offset end sections of said striker jamb leg, and c. a header jamb member having a squared off flat end face at one end thereof and a dadoed or offset section at the other end thereof, whereby said striker jamb leg may be cut off by a predetermined length at one end thereof and said hinge jamb leg may also be cut off one end thereof and said header jamb member rotated to one of its two possible horizontal positions to correctly mate with the top ends of said hinge jamb leg and striker jamb leg, respectively, to thereby accommodate both left handed and right handed doors swingable both into and away from a room, thus enabling said striker plate to be positioned a predetermined distance such as thirty-six inches from a floor or carpet and thereby accommodate the standard thirty-six inch door layout construction.

2. An assembled door jamb including, in combination:

a. a hinge jamb leg having spaced door hinges thereon and flat squared off faces at both ends thereof.

b. an opposing striker jamb leg having a squared off end section adapted to abut a floor or carpet and a dadoed top end section, and further having a striker plate thereon which is positioned closer to one end thereof than the other, and c. a header jamb member having a squared off flat end section mated with said dadoed end section of said striker jamb leg and a dadoed end section mated with said squared off end section of said hinge jamb leg.

3. The door jamb defined in claim 2 wherein said striker plate is located approximately thirty-six (36) inches from said flat squared off end of said striker jamb leg.

4. The door jamb defined in claim 3 wherein said header jamb member is provided with a door stop strip which extends between two facing surfaces of said door stop strips on said hinge and striker jamb legs.

5. A door jamb assembly package comprising:

a. a hinge jamb member having both ends squared off, b. a striker jamb member having both ends dadoed, and c. a header jamb member having one end dadoed and the other end squared off.

6. The package defined in claim 5 wherein said hinge jamb member and said striker jamb member are both of a length dimension greater than the height of a door for which said door jamb assembly is operative to receive.

* * * * *